US006421918B1

(12) United States Patent
Dato et al.

(10) Patent No.: US 6,421,918 B1
(45) **Date of Patent: *Jul. 23, 2002**

(54) HIGH FREQUENCY WET/DRY SHAVING SYSTEM

(75) Inventors: Anthony I. Dato, New Haven; Robert Lozeau, Madison; Stephen Nanchy, Monroe, all of CT (US)

(73) Assignee: Warner-Lambert Company, Morris Plains, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/876,261

(22) Filed: Jun. 16, 1997

(51) Int. Cl.[7] ..... B26B 19/28

(52) U.S. Cl. ..... 30/45; 30/42; 30/44

(58) Field of Search ..... 30/42, 44, 45, 30/43.6, DIG. 1

(56) References Cited

U.S. PATENT DOCUMENTS

| | | | | | |
|---|---|---|---|---|---|
| 2,015,160 | A | * | 9/1935 | Shaler | 30/45 |
| 2,157,492 | A | * | 5/1939 | Livingston | 30/44 |
| 3,509,626 | A | * | 5/1970 | Mead | 30/45 |
| 3,756,105 | A | * | 9/1973 | Balamuth et al. | 30/45 |
| 3,793,723 | A | | 2/1974 | Kuris et al. | |
| 3,980,906 | A | | 9/1976 | Kuris et al. | |
| 4,642,892 | A | * | 2/1987 | Ishida | 30/44 |
| 4,719,698 | A | * | 1/1988 | Ninomiya et al. | 30/43.6 |
| 4,819,330 | A | * | 4/1989 | Fenn et al. | 30/45 |
| 5,007,169 | A | * | 4/1991 | Motta | 30/45 |
| 5,046,249 | A | * | 9/1991 | Kawara et al. | 30/45 |
| 5,299,354 | A | * | 4/1994 | Metcalf et al. | 30/45 |

FOREIGN PATENT DOCUMENTS

DE 2160474 12/1971

* cited by examiner

*Primary Examiner*—Hwei-Siu Payer
(74) *Attorney, Agent, or Firm*—Peter C. Richardson; Gregg C. Benson; Raymond D. Thompson

(57) ABSTRACT

A shaving system which comprises a razor, a razor head and a mechanism for vibrating one or more skin-engaging elements at a frequency ranging from about 15,000 hertz to about 2,000,000 hertz.

15 Claims, 5 Drawing Sheets

HIGH FREQUENCY WET/DRY SHAVING SYSTEM

The present invention relates to shaving systems, and more particularly, to shaving systems which comprises a razor, a razor head and a vibrating mechanism which vibrates the razor head at a supersonic and/or ultrasonic frequency.

BACKGROUND

Several prior art devices have in the past employed shaving systems which vibrate at low frequencies typically within the range of 2,000 to 10,000 hertz. So far as is known, supersonic and/or ultrasonic vibration technology (vibration frequencies greater than 15,000 hertz) has yet to be applied to the razor industry.

It would therefore be desirable to provide a shaving system which incorporates supersonic and/or ultrasonic technology and provides for a system which vibrates one or more of the shaving elements at an supersonic or ultrasonic frequency thereby increasing both the shaving comfort and the shaving efficiency of a typical shaving stroke.

SUMMARY OF THE INVENTION

Various embodiments of the present invention provide shaving systems which can be used for both reusable and disposable razors and comprise a razor, a razor head, and a vibrating mechanism which vibrates the razor head at frequencies in the supersonic to ultrasonic range, e.g. about 15,000 hertz to 2,000,000 hertz.

In one particular preferred embodiment, the vibrating mechanism vibrates the blades in a direction which is substantially parallel to the shaving stroke which is believed to enhance cutting efficiency. In another embodiment, the vibrating mechanism vibrates one or more skin-engaging elements, e.g., the razor blades, at supersonic or ultrasonic frequencies independently of the razor head.

Embodiments of the present invention advantageously comprise a transducer horn which converts the electrical energy emitted from a power source to mechanical vibrations at supersonic or ultrasonic frequencies. Other embodiments comprise a mechanism for adjusting the frequency of vibration.

Still other preferred embodiments of the present invention comprise a power supply which is selectively engageable with a shaving system and/or a power supply which is rechargeable. Other embodiments include an indicator for determining the amount of charge remaining in the power supply.

These and other aspects of the present invention are described in greater detail below.

BRIEF DESCRIPTION OF THE DRAWINGS

In the drawings, where similar reference characters denote similar elements throughout the several views.

DETAILED DESCRIPTION

In accordance with one embodiment the present invention, a shaving system comprises a razor, a razor head, and a mechanism which vibrates the razor head at a supersonic and/or ultrasonic frequency. In another embodiment, the vibrating mechanism vibrates at least one skin-engaging element at supersonic and/or ultrasonic frequencies independently of the razor and the razor head. The frequencies utilized herein are preferably about or above 15,000 hertz.

Preferably, the vibrating mechanism vibrates the razor head and/or the skin-engaging element in a direction which is substantially parallel to the shaving stroke. Advantageously, the amplitude of vibration of the razor head and/or the skin-engaging element(s) is about 10 microns to about 100 microns.

In one particular embodiment, the shaving system is used in combination with a portable or rechargeable power supply which is selectively engageable with the shaving system. Preferably, the power supply includes an indicator for determining the amount of charge remaining in the power supply and/or an indicator which indicates when the power supply needs to be recharged and/or replaced.

In a preferred embodiment of the present invention, the shaving system comprises a supersonic and/or ultrasonic transducer horn which converts alternating-current energy in the supersonic and/or ultrasonic range into mechanical vibration of the same frequency. Preferably, the source of energy encompasses a magnetostriction and/or an electrostriction device which converts alternating-current into mechanical vibration via utilizing the unique field effect (strain) that magnetic or electrical forces have on certain types of material, e.g., ferromagnetic materials.

Figure 2:
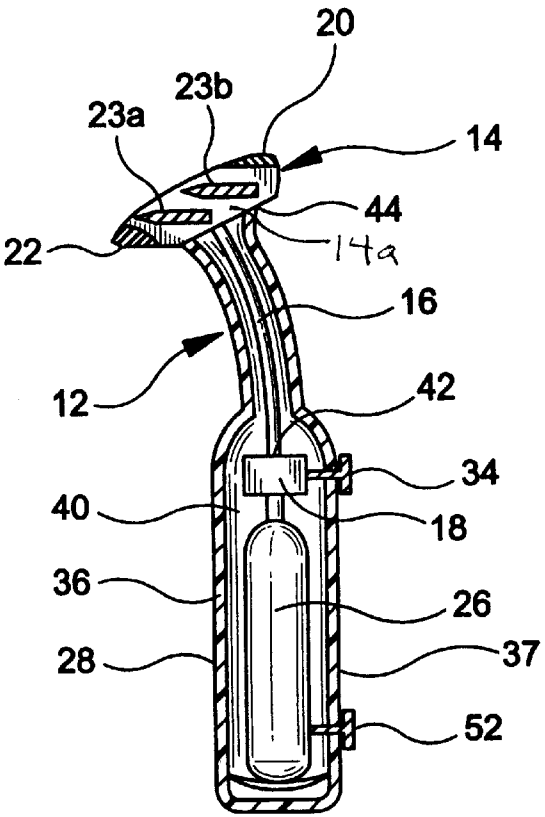
FIG. 2 is a side, cross sectional view of the shaving system, shown in FIG. 1.
Figure 1:
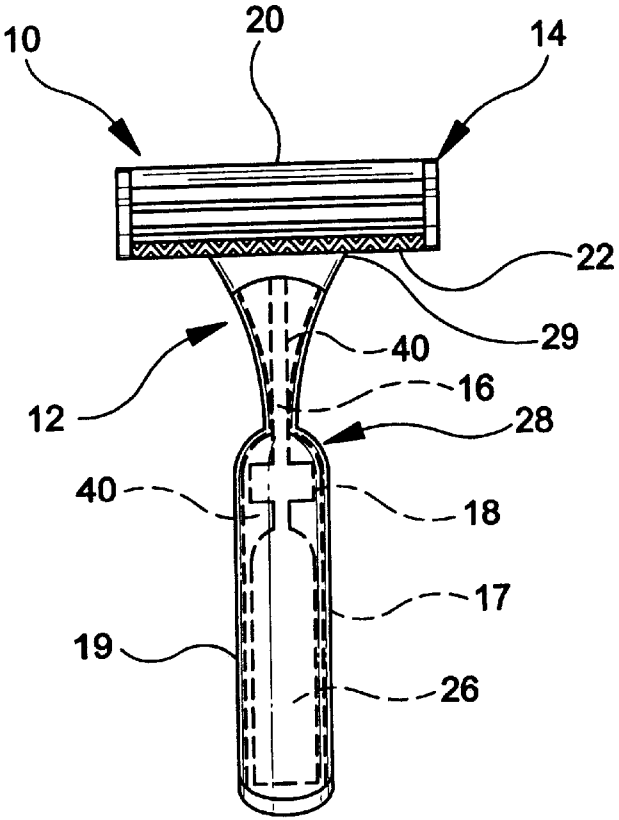
FIG. 1 is a front-perspective view of one embodiment of the shaving system.
Figure 3:
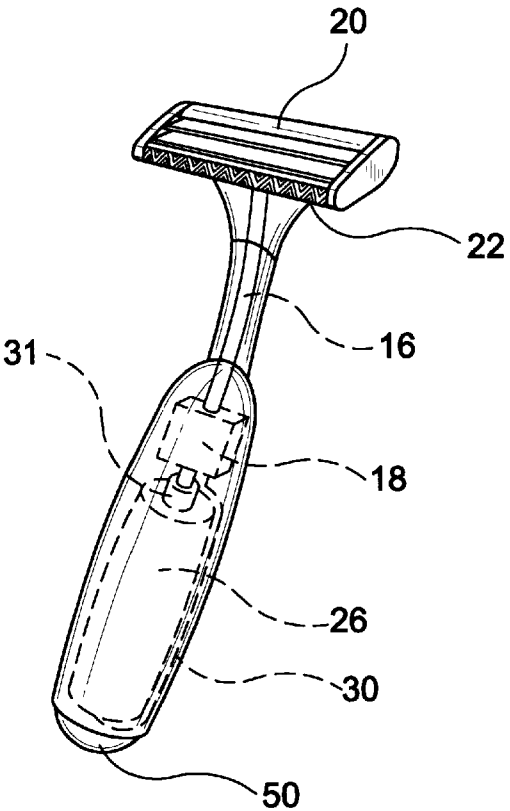
FIG. 3 is a perspective view of the shaving system of FIG. 1 with a phantom line representation of the internal power supply, vibrating mechanism and vibrating horn.

One embodiment of the present invention is illustrated in FIGS. 1–3 and comprises a shaving system 10, preferably made from a hard plastic or some other semi-resilient material, a razor 12 and a razor head 14. Razor head 14 comprises at least one blade disposed within an interior head cavity 14*a*. Preferably, razor head 14 comprises at least two blades within the interior head cavity, e.g., leading blade 23*a* and top blade 23*b*, a cap 20 and a guard element 22. Razor 12 comprises a razor handle 28 having an attachment end 29 for integrally or selectively attaching razor head 14. Preferably, razor handle 28 comprises opposing side walls 17 and 19, front wall 36 and back wall 37, the inner cavities of which together define a cavity 40 for housing at least a power supply 26. Advantageously, cavity 40 is dimensioned to also house a transducer horn 16 and a vibrating mechanism 18. In one particular embodiment, razor handle 28 also comprises an end cap 50 which is threadably engageable with handle 28 and acts to protect cavity 40 and the internal components contained therein from outside elements.

As shown in FIGS. 1–3 cavity 40 generally extends the length of razor handle 28 and is dimensioned to permit horn 16 to vibrate freely within cavity 40. Preferably, horn 16 comprises a top end 44 and a bottom end 42. Advantageously, top end 44 is selectively engageable with razor head 14, but in some cases it may be preferable to integrate horn 16 with razor head 14, e.g., with a disposable razor. Most desirably, bottom end 42 is integral with vibrating mechanism 18, but in some cases, it may be desirable to selectively engage the two components 42 and 18 for manufacturing or other purposes.

Cavity 40 also preferably houses a power supply 26 and a vibrating mechanism 18. Advantageously, power supply 26 is selectively engageable with shaving system 10 and is rechargeable, however, in some cases it may be desirable to provide an outside power supply 26 in order to reduce the overall weight of the shaving system 10 and/or to satisfy consumer preference. Preferably, shaving system 10 also comprises a power meter or indicator 52 which indicates the amount of charge remaining in the power supply 26 and/or indicates when a new power supply, e.g., a new battery, is needed.

Preferably, vibrating mechanism 18 is also housed in cavity 40 and is coupled to power supply 26 via terminals 30 and 31. For the purposes herein, vibrating mechanism 18 generally comprises a device in which ultrasonic or supersonic vibrations are generated by the compression and extension of a core of electrostrictive or magnetostrictive material in a rapidly alternating electric or magnetic field.

For the purposes herein, magnetostriction is defined as "the dependence of the state of strain (dimensions) of a ferromagnetic sample on the direction and extent of its magnetization." Electrostriction is defined as "a form of elastic deformation of a dielectric induced by an electric field, associated with those components of strain which are independent of reversal of field direction, in contrast to the piezoelectric effect." In some cases, however, it may be desirable to use alternate methods of inducing vibration at supersonic and/or ultrasonic frequencies.

As will be appreciated from the present description, vibrating mechanism 18 can convert a supersonic and/or ultrasonic alternating-current emanating from power supply 26 into mechanical energy by causing horn 16 to vibrate at a supersonic and/or ultrasonic frequency. The horn frequency may be substantially equivalent to the a.c. frequency. Horn 16, in turn, causes razor head 14, blades 23*a* and 23*b* (See FIGS. 4–8), or one or more other skin engaging elements to vibrate at about or above 15,000 hertz. It is believed that vibrating the shaving elements at a certain supersonic and/or ultrasonic frequency having a predetermined amplitude will provide a dynamic cutting action which is superior to that of a normal shaving stroke, i.e., the supersonic and/or ultrasonic vibration is provided to enhance the cutting action through the hair and reduce the "pull" normally associated with the shaving stroke. It is further believed that at supersonic and/or ultrasonic frequencies, vibration heat will be generated which will tend to soften the facial hair thereby reducing the force required to cut the hair. As can be appreciated from the present invention, these unique features will tend to reduce the discomfort normally associated with shaving and may also allow "dry shaving" which would save the consumer considerable cost since soaps and gels will not be required.

In the particular embodiment shown in FIG. 2, shaving system 10 also comprises a dial 34 which allows a consumer to selectively adjust the vibrating mechanism 18 (i.e., adjust the vibrating frequency of the razor head 14 or blades 23*a*, 23*b*) and/or the amplitude of the vibration according to his or her particular preference and/or particular shaving needs. Preferably, the range of amplitude vibration is about 10 to about 100 microns.

Figure 4:
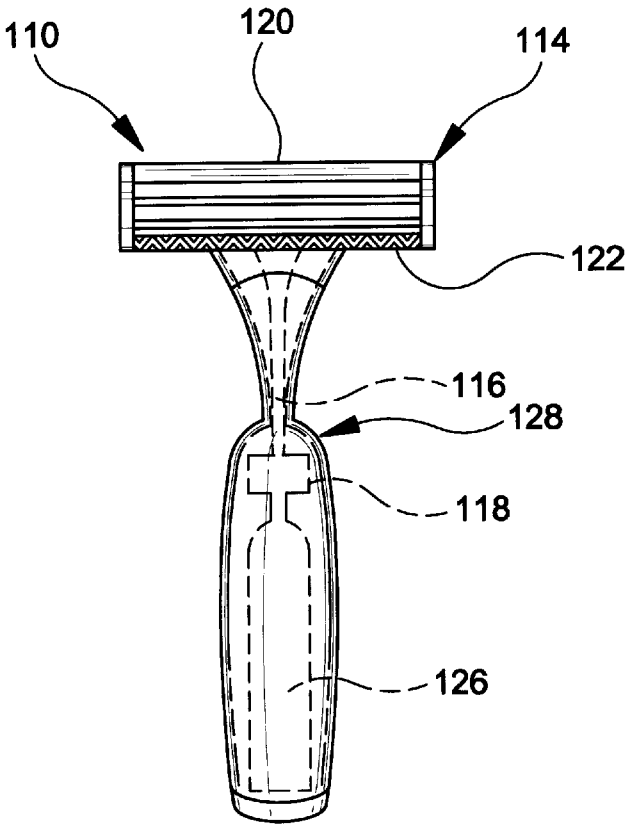
FIG. 4 is a front view of another embodiment of the shaving system wherein the blades vibrate independently of the razor head at a supersonic and/or ultrasonic frequency.
Figure 6:
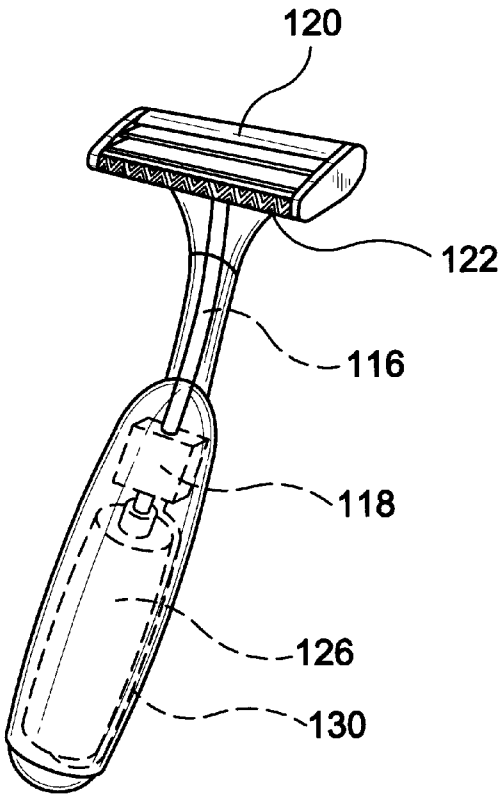
FIG. 6 is a perspective view of the shaving system of FIG. 4 showing a phantom line representation of the internal power supply, vibrating mechanism and vibrating horn.
Figure 5:
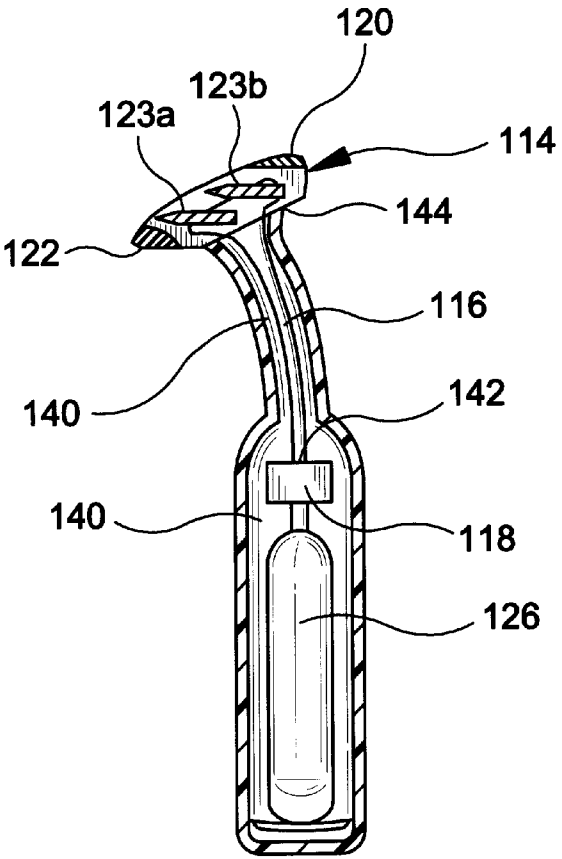
FIG. 5 is a side, cross sectional view of the shaving system, shown in FIG. 4.

FIGS. 4–6 show an alternate embodiment of the present invention wherein the vibrating horn 116 vibrates the blades 123*a*, 123*b* independently of the razor head 114. This alternative embodiment contains razor handle 128, power supply 126 and terminal 130. As can be appreciated from the present disclosure, shaving system 110 can be designed so that any skin-engaging element or other portion of the razor head 114, e.g., guard member 122 or cap 120, can be made to vibrate independently of razor head 114 or other skin-engaging elements.

FIG. 5 shows a side, cross section of shaving system 110 which comprises a vibrating horn 116 internally housed within the upper end of cavity 140 and integrally attached to vibrating mechanism 118 at bottom end 142. Blades 123*a* and 123*b* are integrally attached to horn 116 near top end 144. As can be appreciated, when horn 116 is caused to vibrate at supersonic and/or ultrasonic frequencies, blades 123*a* and 123*b* will also vibrate at or near the same frequency.

Figure 7:
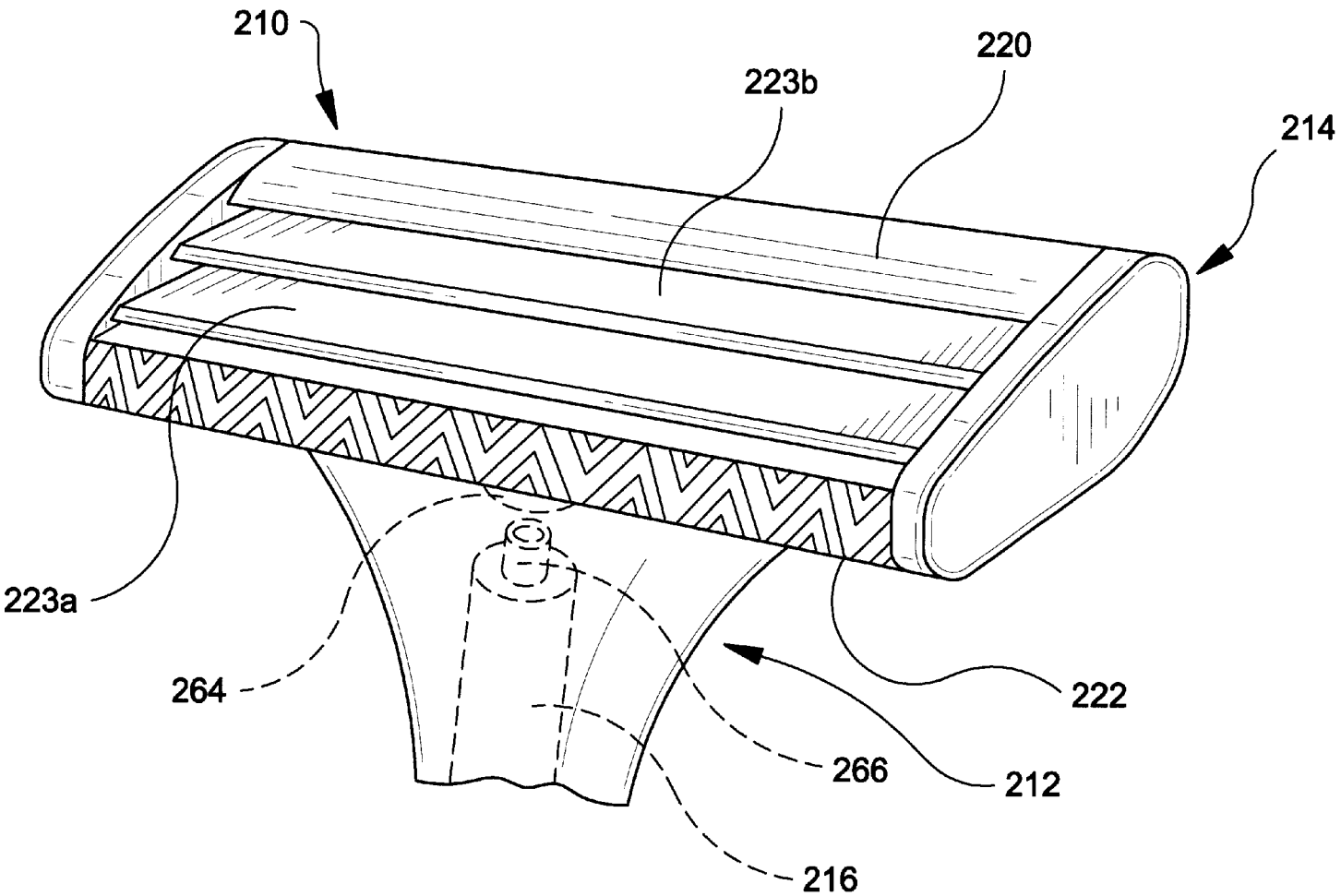
FIG. 7 is a close-up perspective view of an alternate embodiment of the present invention showing the blades seated within a support member which is engageable with the transducer horn.
Figure 8:
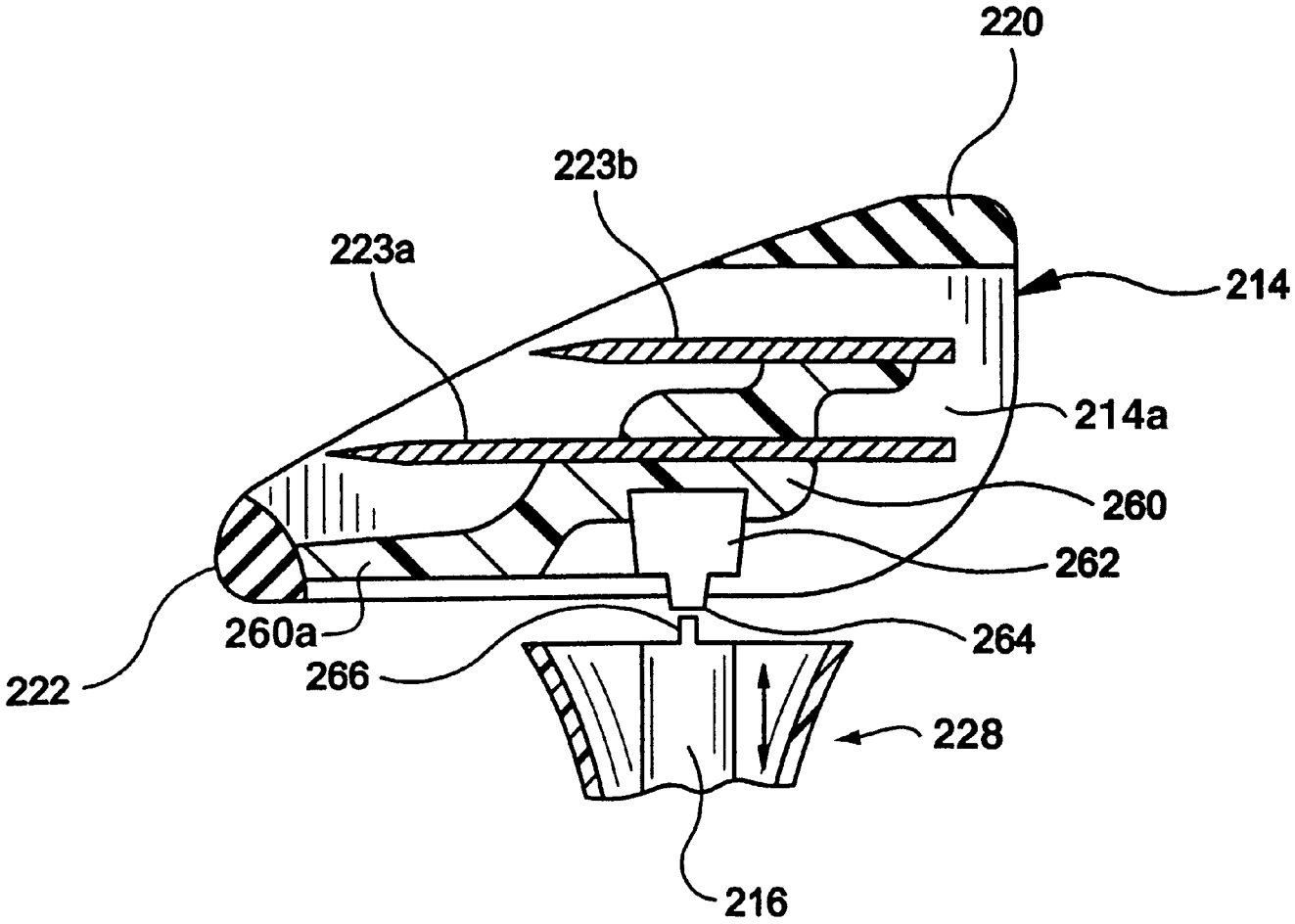
FIG. 8 is an exploded side, cross-sectional view of the embodiment of FIG. 7.

FIGS. 7 and 8 show another embodiment of the present invention wherein shaving system 210 comprises razor head 214 which is selectively engageable with razor 212 by way of an engagement mechanism (not shown). In this particular embodiment, blades 223*a* and 223*b* are seated upon a support member 260 which is disposed within an interior head cavity 214*a* defined by the razor head 214. Support member 260 comprises a depending portion 262 having a detent 264 which, preferably, protrudes downwardly therefrom. Detent 264 is dimensioned and aligned so as to selectively engage the uppermost end 266 of horn 216 when razor head 214 is configured for use. When a vibrating mechanism [not shown] is activated, horn 216 will cause detent 264 and depending portion 262 to vibrate which, in turn, will vibrate blades 223*a* and 223*b*. In the FIG. 8 embodiment the handle 228 is mated with the shaver head 214 independently of the connection between blade support member 260 and the ultrasonic horn 216. A flexible resilient strut 260*a* allows the blades 223*a* and 223*b* to be vibrated (in the direction of the arrow) without causing unwanted vibration of the shaver head 214.

Preferably, blades 223*a* and 223*b* are caused to vibrate at the same frequency, but in some cases it may be desirable to dampen the vibration of a particular blade, e.g., 223*b*, or, in other cases, it may be desirable to only vibrate one blade independently of the other blade(s). Still in other cases it may be desirable to dimension horn 216 so as to engage and vibrate another skin-engaging element such as cap 220 and/or guard member 222.

From the present description, those skilled in the art will appreciate that various other modifications which may be made without departing from the scope of the present invention. For example, while preferably the shaving system 10 is made from resilient plastic, it may be desirable to make the shaving system 10, or a portion thereof, from another material, such as aluminum or some other semi-flexible material.

Advantageously, horn 16 is internally disposed within cavity 40, however, in some cases it may be desirable to have the entire upper portion of the handle act as the vibrating horn.

In the particular embodiment shown in FIGS. 7 and 8, horn 216 engages portion 262 which depends from support 260, however, in some cases it may be desirable to have horn

216 directly engage and vibrate blades 223*a* and 223*b* independently of support member 260, e.g., by providing recesses within support member 260 through which portion 262 extends to engage horn 216.

It is believed that one of the major benefits associated with the present invention is that frequencies in the above noted range can provide a safer, cleaner, less expensive and more efficient way of cutting unwanted body hair. In addition, it is believed that the present invention will encourage "dry shaving" which will both reduce the overall cost of the shaving process and may particularly help those consumers who are allergic to shaving soaps and gels.

What is claimed is:

1. A shaving system comprising:

a shaving head defining an interior cavity, and having a guard element;

at least one elongated generally flat blade element;

a hand held hollow housing secured to said shaving head, and defining an elongated passageway communicating with said interior cavity of said shaving head; and an ultrasonic transducer horn in said elongated passageway, said ultrasonic transducer horn having a free end portion extending into the interior cavity and supporting said at least one blade element for vibratory motion relative to said guard element, said vibratory motion having an amplitude that moves the elongated blade in substantially parallel relation to a shaving stroke, said ultrasonic transducer horn free end portion connected to said shaving head by a resilient strut, said strut so oriented as to flex during said vibratory motion so that the at least one blade element moves relative to the shaving head and the guard element.

2. The shaving system of claim 1 wherein said blade element is carried by a support member, said ultrasonic transducer horn free end portion being releasably secured to said support member, and said shaving head being releasably secured to said hollow housing.

3. The shaving system of claim 1 wherein a second elongated generally flat blade element is provided in said head.

4. A shaving system comprising:

a shaving head defining an interior cavity, and having a guard element;

at least one elongated generally flat blade element;

a hand held hollow housing secured to said shaving head, and defining an elongated passageway communicating with said interior cavity of said shaving head; and an ultrasonic transducer horn in said elongated passageway, said ultrasonic transducer horn having a free end portion extending into the interior cavity in said shaving head and supporting said at least one blade element for vibratory motion relative to said guard element, said vibratory motion having an amplitude that moves the elongated blade in substantially parallel relation to a shaving stroke, wherein said blade element is carried by a support member, said ultrasonic transducer horn free end portion being releasably secured to said support member, and said shaving head being releasably secured to said hollow housing.

5. The shaving system of claim 4 wherein a second elongated generally flat blade element is provided in said head.

6. The saving system of claim 4 further comprising means in said hollow housing for vibrating said ultrasonic transducer horn and its free end portion relative to said handle and said shaving head.

7. The shaving system of claim 6 wherein said vibratory motion has an amplitude between 10 to 100 microns.

8. The shaving system of claim 6 wherein said vibratory motion has a frequency between 15,000–2 million hertz.

9. The shaving system of claim 6 wherein said ultrasonic transducer horn is made from a material selected from the group consisting of magnetorestrictive and electrorestrictive transducer materials.

10. The shaving system of claim 9 wherein said means in said hollow housing for vibrating is selected from magnetorestrictive and electrorestrictive devices which convert electrical AC energy to mechanical vibratory motion of said ultrasonic transducer horn.

11. The shaving system of claim 10 further including a source of electrical AC energy in said hollow housing.

12. The shaving system of claim 11 wherein said source of electrical AC energy includes a rechargeable electrical energy source.

13. The shaving system of claim 12 wherein said rechargeable energy source is removable for replacement.

14. The shaving system of claim 13 further including means for indicating the state of said rechargeable source.

15. The shaving system of claim 11 further including means for adjusting the frequency of said vibratory motion.

* * * * *